United States Patent [19]

Kryder

[11] Patent Number: 4,693,570

[45] Date of Patent: Sep. 15, 1987

[54] SPORTS TRAINING APPARATUS

[76] Inventor: Ralph W. Kryder, 4481 S. Buffalo Rd., Orchard Park, N.Y. 14127

[21] Appl. No.: 857,733

[22] Filed: Apr. 29, 1986

Related U.S. Application Data

[63] Continuation of Ser. No. 532,841, Sep. 16, 1983, abandoned.

[51] Int. Cl.[4] ..... G02B 5/08; G02B 5/10

[52] U.S. Cl. ..... 350/616

[58] Field of Search ..... 350/613, 616, 631, 632

[56] References Cited

U.S. PATENT DOCUMENTS

| | | | |
|---|---|---|---|
| 365,183 | 6/1887 | Hufeland | 350/615 |
| 918,471 | 4/1909 | Reaves | 350/615 |
| 2,464,292 | 3/1949 | Chilo . | |
| 2,494,000 | 1/1950 | Robertson . | |
| 2,875,528 | 3/1959 | Garate . | |
| 3,140,550 | 7/1964 | Wayfield . | |
| 3,450,465 | 6/1969 | Prance et al. . | |
| 3,874,966 | 4/1975 | Garcia . | |
| 4,083,559 | 4/1978 | Owen, Jr. . | |
| 4,232,075 | 11/1980 | Gantz et al. | 350/616 |
| 4,423,719 | 1/1984 | Hutchinson | 350/632 |

*Primary Examiner*—John K. Corbin
*Assistant Examiner*—Vincent J. Lemmo
*Attorney, Agent, or Firm*—Gunn, Lee & Jackson

[57] ABSTRACT

Apparatus for training athletes comprising a mirror assembly which permits the athlete to view all his body movements. The apparatus comprises a shock resistance mirror assembly including a sheet of clear acrylic material and a sheet of mirrored acrylic material in facing contact which may be variously mounted to permit an athlete a full body view of his image. Two or more mirror assemblies may be joined end to end.

7 Claims, 9 Drawing Figures

FIG. 2
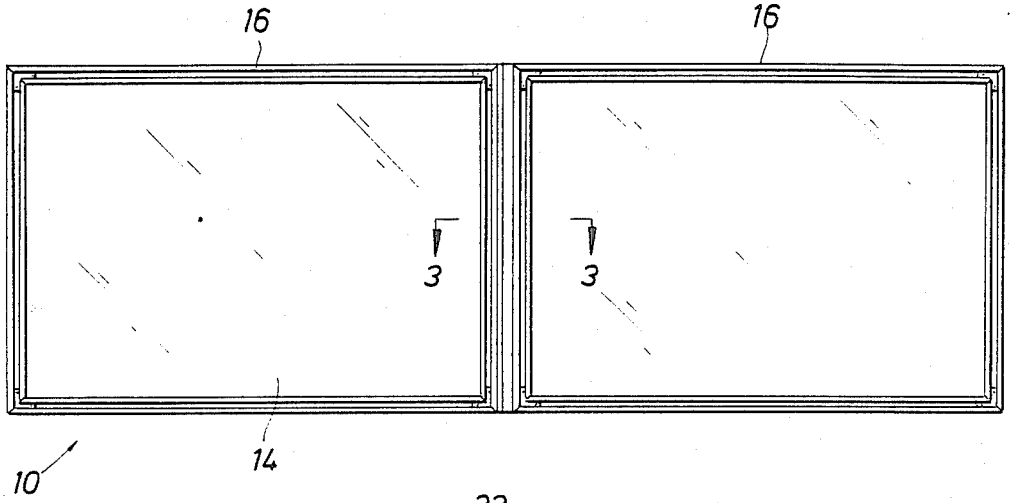
FIG. 3
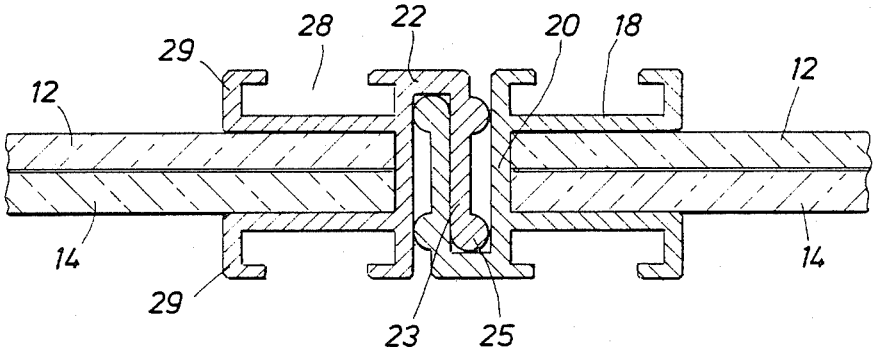
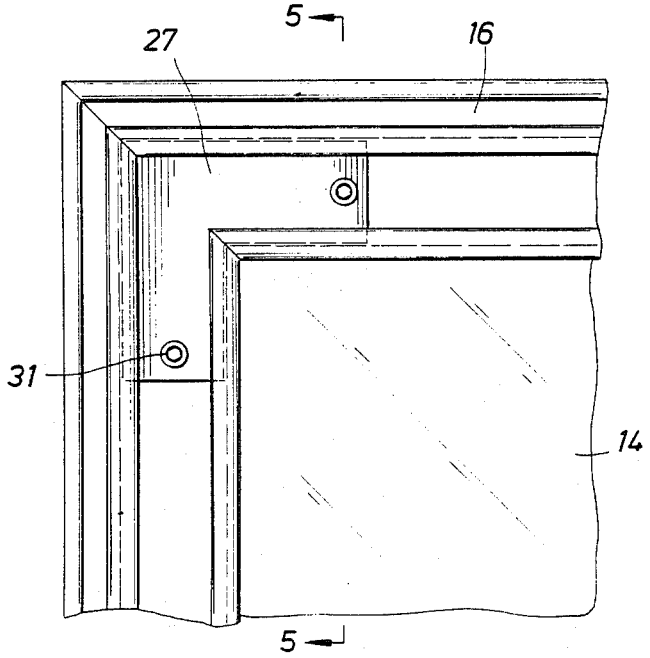
FIG. 4
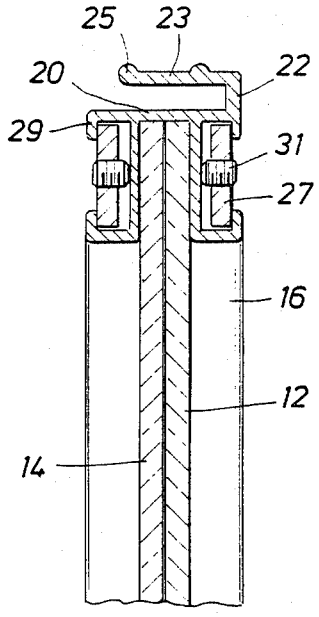
FIG. 5

FIG. 6
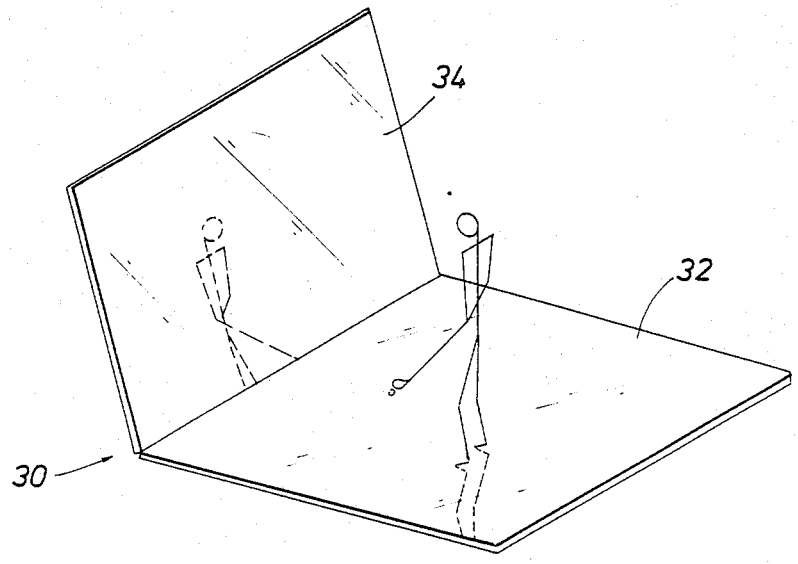
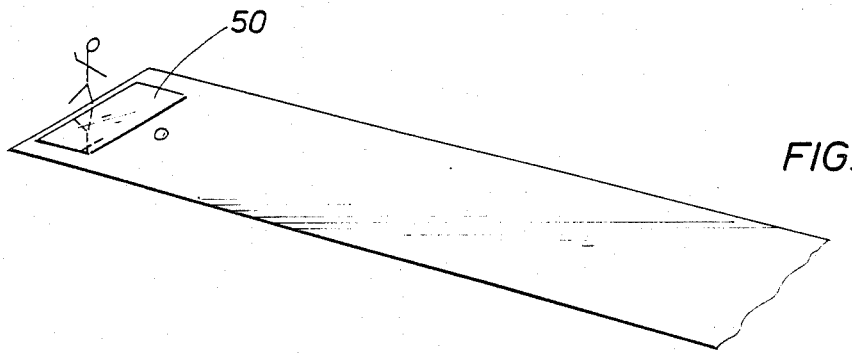
FIG. 7
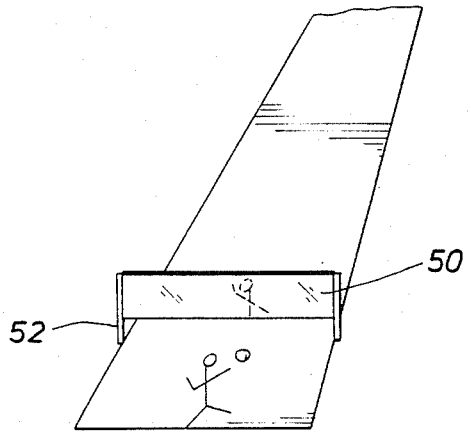
FIG. 8

SPORTS TRAINING APPARATUS

This is a continuation of application Ser. No. 532,841 filed Sept. 16, 1983, now abandoned.

BACKGROUND OF THE INVENTION

This invention relates to apparatus for use in giving athletes instruction and more particularly an apparatus including a mirror which permits an athlete to study his body movements for improving his performance.

Many devices exist in the prior art directed to the problem of teaching athletes proper body movements for various sports. These devices include apparatus which require the strapping of the athletes limbs to various moving elements of the apparatus which provides an artificial character to the instruction and forces rather than guides the athlete through the proper motions.

One prior art device is described in U.S. Pat. No. 3,140,550 to Wayfield. The Wayfield patent describes an apparatus which enables the swimmer to be guided through the various stages of instructions and to learn the various movements of the body and how to coordinate them. The apparatus comprises a cabinet adapted to receive the body of a swimmer and dimensioned to provide unobstructed use of the arms and legs in executing swimming strokes. The cabinet includes a plurality of fluid expelling nozzles appropriately located for releasing fluid under pressure in a timed relation to indicate to the swimmer appropriate coordination of the parts of the body in executing swimming strokes.

A swimming instruction device is also disclosed by U.S. Pat. No. 2,875,528 to Garrett describing an apparatus on which a swimmer is supported at the correct level in the water under conditions in which both the swimmer and instructor may observe the arm and leg actions of the swimmer. The apparatus comprises a tank filled with water having a post appropriately located therein for supporting a swimmer at a desired level within the tank and leaving the arms and legs of the swimmer free to move. A series of windows and a system of mirrors are provided so that the instructor and swimmer, respectively, may observe the arm and leg movements in executing swimming strokes.

Owens, Jr., U.S. Pat. No. 4,083,559 describes an apparatus for training players in baseball and other sports. The apparatus employs a mirror which permits the player to view all his body movements while projecting the ball toward the mirror as a target. The apparatus comprises a shock resistent mirror which may be variously mounted for angular adjustment to permit the player a full body view of his image. The mirror is suspended from a crossbar and may be positioned in an appropriate manner independently of a netting or like web surrounding the mirror.

Robertson, U.S. Pat. No. 2,494,000 describes a method and apparatus for teaching manual skills to golfers. Robertson provides a means for comparing the golfers body movements to follow as closely as possible the body movements of an expert performing the same stroke. This is accomplished by projecting the image of an expert performing a skill on a screen and superimposing on the continuously moving image of the expert the continuously moving image of the golfer performing the same skill as he endeavors to match his movements in time and position with those of the expert.

SUMMARY OF THE INVENTION

The apparatus of the invention comprises a mirror assembly including two sheets of shatter resistent acrylic plastic having reflective characteristics. The acrylic plastic sheets are held together by a peripheral channel-like framewok engaging the exposed edges of the sheet members. The framework includes means for suspending the mirror assembly from a wall or the like.

BRIEF DESCRIPTION OF THE DRAWINGS

So that the manner in which the above recited features, advantaes and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a front view showing the apparatus of the invention connected in series;

FIG. 3 is a sectional partially broken away view of the apparatus of the invention taken along line 3—3 of FIG. 2;

FIG. 4 is a front partially broken away view showing the edge locking apparatus means for the apparatus;

FIG. 5 is a sectional view taken along line 5—5 of FIG. 4;

FIG. 6 is a perspective view of an alternate embodiment of the invention used for golfing instruction;

FIG. 7 is another alternate embodiment of the invention used for bowling instruction;

FIG. 8 is another alternate embodiment of the invention used for bowling instruction.

DETAILED DESCRIPTION OF THE INVENTION

Figure 1:
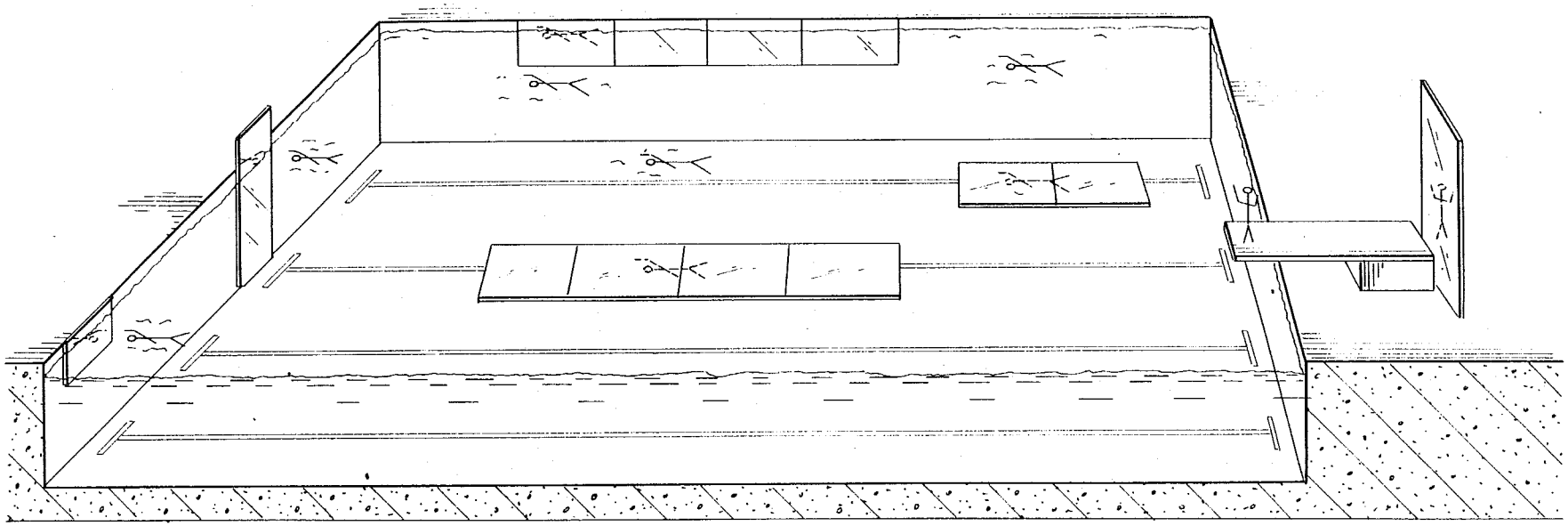
FIG. 1 is a perspective partially broken away view of a swimming pool showing use of one embodiment of the invention.

Referring first to FIGS. 2 and 3, the instructional apparatus of the invention is generally identified by the reference number 10. The mirror assembly 10 comprises a pair of acylic plastic sheets 12 and 14. The sheets 12 and 14 are stacked or positioned adjacent to each other so that they are in facing contact. The sheets 12 and 14 are held together by a frame 16 enclosing the edges thereof. The frame 16 has a channel like configuration formed by spaced and parallel leg members 18 extending upwardly from a base member 20 defining a channel cavity to receive the edges of the sheets 12 and 14. The frame 16 is fabricated of a plexiglass material and frictionally engages the surface of the sheets 12 and 14 along the edges thereof.

An interconnecting flange assembly extends along the frame 16. The interconnecting assembly comprises a leg member 22 perpendicular to the exposed surface of the base member 20 and a flange member 23 spaced and parallel to the base member 20. The interconnecting flange member is an integral part of the frame 16. The flange assembly enables connecting a series of mirror assemblies 10 as shown in FIG. 2. The assemblies 10 are connected together by sliding the flange member 23 of one assembly 10 into the channel defined by the flange member 23 and base member 20 on the frame 16 of the other or adjacent assembly 10 as shown in FIG. 3. The flange member 23 includes a plurality of beads 25 on the exposed surface thereof. The beads 25 are slightly yieldable for gripping the walls of the channel when the assemblies 10 are interconnected as shown in FIG. 3.

The frame 16 includes oppositely facing locking channels 28 defined by pairs of L-shaped legs 29. A plurality of lock members 27 are received within the channels 28 at each corner of the assemblies 10. The locking members 27 are fastened in the channels 28 by set screws 31 as best shwon in FIG. 4. Locking the frame 16 in this manner provides excellent rigidity for the assemblies 10.

The sheets 12 and 14 are resistent to shock and are fabricated of acrylic material. One sheet acrylic material is mirrored and the other sheet is clear. Acrylic plastic is extremely resistent to breakage, yet it is lightweight. A four by eight foot sheet of acrylic plastic weighs approximately twenty-four pounds. Thus, the apparatus of the invention comprising two acrylic sheets weights approximately fifty pounds including the frame 16.

Due to its lightweight construction, the mirror assembly 10 of the invention is portable and easily positioned for use without requiring special mounting equipment. For example, the mirror assembly 10 may be hung on a wall suspended from a rope or wire having the ends thereof extending through channel 28 in the fashion of a picture or the like. Alternatively, the mirror assembly 10 may be suspended from adjustable hooks or the like.

Referring now to FIG. 1, the mirror assembly 10 of the invention is shown used in swimming instruction. A plurality of mirror assemblies of the invention are shown located at various points about a swimming pool to assit the swimmer in developing proper swimming strokes. A series of mirror assemblies are located at various locations in the pool. The mirror assemblies are joined by the interlocking flange assemblies in the manner shown in FIG. 4. The interlocking flange assemblies are provided with oppositely facing channels for receiving the edges of adjoining mirror assemblies.

In FIG. 1, the various uses of the apparatus of the invention in a swimming pool are disclosed. The mirror assemblies are strategically located about the pool so that a swimmer may observe his body movements while performing various swimming strokes. For example, the mirror assemblies located at the bottom of the pool are ideally suited for observing horizontal motions of butterfly, breast stroke and free style strokes. The series of mirror assemblies located along the side of the pool are ideally suited for observing vertical motions of butterfly, breast stroke, and free style strokes. Likewise, a mirror assembly located near the back of the diving board permits the diver to check his poise and form on back take-offs from the diving board. The horizontal mirror assembly at one end of the pool permits a swimmer to watch his swimming motion from the front while performing butterfly, breast stroke and free style strokes. The end mounted or vertical mirror assembly permits a swimmer to observe his back stroke motions, particularly, hand entry into the water.

An alternate embodiment of the apparatus of the invention is shown in FIG. 6. In this embodiment, the apparatus 30 is used to assist a golfer in developing a proper swing. The apparatus 30 comprises a horizontal mirror assembly 32 and an oblique mirror assembly 34 extending outwardly from the mirror assembly 32 at a 45° angle. The golfer stands on the mirror assembly 32 and watches his swing from below in the mirror assembly 32 and from in front in the mirror assembly 34 while keeping his eye on the ball.

In FIGS. 7 and 8, an alternate embodiment of the invention for use in bowling instruction is shown. In this embodiment, the apparatus 50 is mounted on legs 52 above the bowling lane several feet from the scratch line. The mirror assembly 50 is approximately two feet in height so as not to obscure the bowlers view of the pins. The bowler is able to observe his approach, back swing and release of the bowling ball in the mirror assembly 50. Alternatively, the mirror assembly 50 may be horizontally mounted in the bowling lane as shown in FIG. 7.

Figure 9:
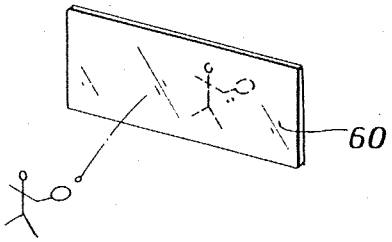
FIG. 9 is another alternate embodiment of the invention used for tennis instruction.

In FIG. 9, an embodiment of the invention used for tennis instruction is shown. In this embodiment, the mirror assembly 60 is positioned so that a tennis player hits the ball against the surface of the mirror assembly. The mirror assembly 60 may be mounted to a fence or next to the tennis net on suitable supports. The tennis player hits the ball against the mirror assembly 60 and observes his approach, swing and follow through.

In summary, the present invention discloses a mirror assembly and frame which may be conveniently used in various sports for athletic instruction by permitting athletes to study their body movements and thereby improve their performance.

While the foregiong is directed to the preferred embodiment of the invention, other and further embodiments of the invention may be devised without departing from the basic concept thereof, the scope thereof is determined by the claims which follow.

What is claimed is:

1. A sports training apparatus comprising:

(a) a mirror assembly including a sheet of clear acrylic material and a sheet of mirrored acrylic material in facing contact;

(b) a frame extending about the edges of the acrylic sheets, said frame including interlocking channels extending about said frame and integral therewith, said interlocking channels cooperating together for joining at least two mirror assemblies end to end;

(c) means for mounting said assembly for use in various sports, and (d) wherein said interlocking channels are formed by a leg member extending outwardly from and substantially perpendicular to a base member of said frame and a clamp member extending from said leg member spaced from and substantially parallel to said base member.

2. The apparatus of claim 1 wherein said frame includes flange means for mounting said mirror assembly on a support structure.

3. The apparatus of claim 1 wherein said mirror assembly includes a horizontal portion and an oblique portion angled outwardly from said horizontal portion at about 45°.

4. The apparatus of claim 1 wherein said mirror assembly is mounted across one end of a bowling lane on vertically extending supports permitting a bowler to view his body movements while bowling.

5. The apparatus of claim 1 including a front surface resistant to the shock of a standard tennis ball hit against said front surface.

6. The apparatus of claim 1 wherein said frame includes oppositely facing locking channels formed by pairs of L-shaped legs, said locking channels extending along the longitudinal length of said frame.

7. The apparatus of claim 6 wherein said locking channels are adapted to receive locking member located at each corner of said mirror assembly.

* * * * *